United States Patent [19]

Wittersheim et al.

[11] Patent Number: 4,597,683

[45] Date of Patent: Jul. 1, 1986

[54] APPARATUS FOR APPLYING COSMETIC PREPARATIONS

[75] Inventors: Adam Wittersheim, Mühltal; Günter Much, Darmstadt, both of Fed. Rep. of Germany

[73] Assignee: Goldwell GmbH, Chemische Fabrik H. F. Dotter, Darmstadt-Eberstadt, Fed. Rep. of Germany

[21] Appl. No.: 554,564

[22] Filed: Nov. 22, 1983

[30] Foreign Application Priority Data

Nov. 25, 1982 [DE] Fed. Rep. of Germany ..... 3243581

[51] Int. Cl.[4] ..... A45D 40/10; A45D 34/00

[52] U.S. Cl. ..... 401/4; 401/39; 401/180

[58] Field of Search ..... 401/180, 4, 176, 39

[56] References Cited

U.S. PATENT DOCUMENTS

| | | | |
|---|---|---|---|
| 677,667 | 7/1901 | Kirschen | 401/4 X |
| 1,294,914 | 2/1919 | Kato | 401/4 |
| 3,195,168 | 7/1965 | Roberts | 401/180 X |
| 4,309,119 | 1/1982 | Wittershiem | 401/176 X |

FOREIGN PATENT DOCUMENTS

| | | | |
|---|---|---|---|
| 2824525 | 12/1979 | Fed. Rep. of Germany . | |
| 57306 | 1/1953 | France | 401/180 |
| 60969 | 2/1955 | France | 401/180 |
| 471960 | 6/1952 | Italy | 401/180 |
| 380578 | 9/1964 | Switzerland | 401/180 |
| 118142 | 3/1958 | U.S.S.R. | 401/180 |

*Primary Examiner*—Steven A. Bratlie

[57] ABSTRACT

Apparatus for applying cosmetic preparations in liquid or paste form comprising a cylindrical casing provided with a slidable piston which divides the casing into first and second chambers which are sealed relative to one another. The first chamber contains a mixing member which by an operating stem guided sealingly to the outside through the piston and the second chamber, can be reciprocated inside the first chamber. This first chamber may be filled with a cosmetic preparation to be emptied by controllable amounts by an applicator detachably fastened to the casing. A tubular casing extension is inserted into the free end of the second chamber and contains a compression spring for pre-stressing the piston. The casing extension is telescopically movable into and out of the second chamber. At the free end of the casing extension a locking mechanism is provided by which the casing extension, when fully inserted into the casing, can be detachably locked to the casing.

6 Claims, 2 Drawing Figures

APPARATUS FOR APPLYING COSMETIC PREPARATIONS

Figure 1:
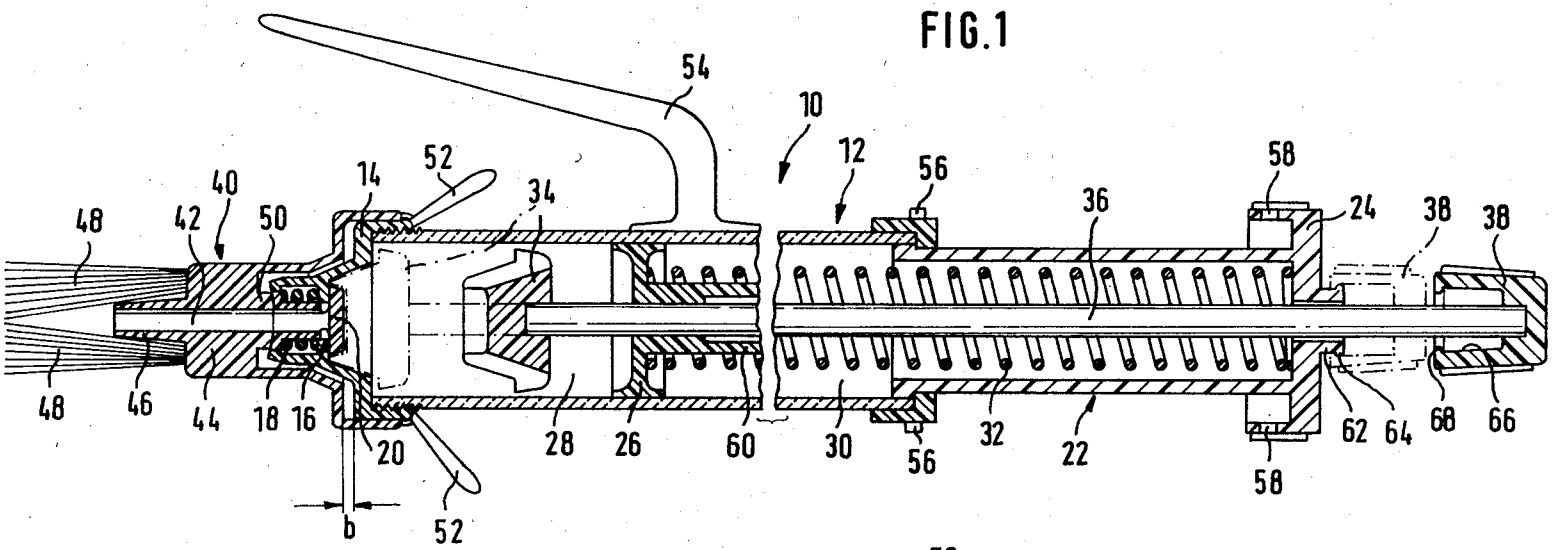

The invention relates to an apparatus for applying cosmetic preparations, which comprises a closed, substantially cylindrical casing containing a slidably inserted piston which divides the casing into two chambers of variable size, which are sealed relative to one another and of which one is adapted to be filled with the cosmetic preparation and is in communication with a detachable applicator provided with a through channel for the preparation which is to be applied, by means of which applicator the preparation can be applied in controllable amounts by means of an operating valve to the part of the body which is to be treated, while in the other chamber of variable size, lying opposite the chamber containing the preparation, a compression spring urging the piston in the direction of a reduction in size of the chamber containing the preparation is provided, and in the chamber containing the preparation a mixing member is disposed which is adapted to be moved reciprocatingly inside the chamber containing the preparation by means of an operating stem connected to it on the piston side and guided to the outside sealingly through the piston and through the chamber of variable size containing the compression spring.

An apparatus of this kind, intended for applying hair dye preparations in paste form to hair which is to be dyed, is known (German Offenlegungsschrift No. 2,824,525). The applicator of this apparatus is however in the form of a comb, which consists of an elongated tubular part which is adapted to be attached to the casing and from which hollow teeth project at right angles and, in the region of their free ends, are provided with one or more openings for discharging the dye preparation. The preparation therefore passes from the piston prestressed by a coil spring out of the casing, which at the same time serves as handle, into an elongated tubular part and thence through the teeth to the openings in the latter, the amount of preparation being controlled by an operating valve integrated into the comb member. For the purpose of transferring the dye onto the hair undergoing treatment, the comb member is passed through the hair. Although in principle the apparatus is capable of functioning and facilitates the actual operation of applying the preparation, in comparison with the still predominantly usual practice of applying the hair dye preparation, prepared in a mixing bowl, by means of a brush, it has a number of disadvantages which have in practice prevented its use as a hairdresser's working implement. Particularly when it is used for applying hair dye preparations, the through channels, particularly in the comb member, can become clogged unless the apparatus is stripped down and carefully cleaned immediately after use. Another disadvantage of the known apparatus is to be seen in the fact that for the purpose of filling it with the preparation, the piston must first be drawn back against the action of the spring continuously acting on it and must be locked in the retracted position, whereupon the casing is opened, the components of the preparation are introduced, and thereupon the casing must be closed again. After the components of the preparation have been thoroughly mixed by means of the mixing member, the spring is then released and the apparatus is ready for use.

In contrast thereto, the Appicants have developed an applicator apparatus (U.S. Pat. No. 4,309,119), in which the chamber containing the preparation can be filled, without opening the apparatus, with hair dye paste by means of an aerosol supply can and can be filled with oxidising liquid from a reservoir, with the aid of a hand pump, through a self-closing valve, which at the same time also acts as the operating valve. Thus the apparatus does not have to be opened in order to introduce the components of the preparation. The apparatus is operated by means of a push rod member which is incorporated in the applicator and which acts on the valve. For the purpose of loading the piston, the pressure chamber which lies opposite the chamber containing the preparation, and which was bled to the atmosphere during filling with the components of the preparation, is filled with a pressurised gas (for example a halogen hydride propellant). This apparatus has proved its usefulness in practice. However, before every refilling of the apparatus the propellant must be discharged and, after the preparation has been introduced, the pressure chamber must be refilled with propellant. Since it has recently been found that halogen hydride propellant gases can damage the ozone layer of the earth's atmosphere, efforts are being made to abandon the use of such propellant gases. Although in principle it is possible to replace halogen hydride propellant gases with harmless propellant gases such as carbon dioxide or compressed air, these gases must then be highly compressed in order to achieve an adequate piston stroke when large amounts of preparation have to be applied. This in turn requires careful sealing and larger dimensions of the casing to cope with the higher pressure. Moreover, in this case also a certain amount of the compressed gas is consumed for each filling of the apparatus.

In contrast thereto, the problem underlying the invention is that of providing an application apparatus which combines the advantages of the apparatus loaded with a mechanical compression spring with those of an apparatus loaded with compressed gas.

Taking as a starting point an application apparatus of the kind first mentioned above, this problem is solved according to the invention when the free end of the chamber of variable size, containing the compression spring, in the cylindrical casing holds a tubular casing extension which is adapted to slide telescopically into this chamber and to be extracted from it as far as an end position, and into which the end region of the compression spring remote from the piston is inserted and supported, and in that at the free end of the casing extension locking means are provided by which the casing extension fully inserted into the casing can be detachably locked to the casing. The proposed casing extension on the one hand permits the use of a compression spring of relatively great length and low initial prestress, so that during the filling of the casing with components of the preparation only slight antagonistic forces have to be overcome, which means that, similarly to the abovementioned known application apparatus which is loaded with compressed gas only after the filling operation, the components of the preparation can be introduced through the operating valve from an aerosol can or with the aid of an ordinary hand pump into the closed casing, without unloading the chamber containing the compression spring and without opening the chamber into which the preparation has to be filled. On the other hand, the prestressing of the compression spring can be substantially increased through the insertion of the casing extension into the casing and the locking of the extension to the casing, so that the expulsion of even highly viscous preparations, that is to say those in paste form, into the applicator is ensured.

In a preferred further development of the invention there is disposed at the free end of the casing extension an end cap which engages over the free end of the cylindrical casing in the fully inserted position, and the locking means are disposed in the end cap and the end portion of the casing over which the cap engages. The locking means are expediently in the form of a bayonet fastening.

The operating stem of the mixing member is made so long in an advantageous further development of the invention that in the extended position of the casing extension, and with the mixing member fully pushed to the applicator end of the chamber containing the preparation, it still projects through an opening in the free end of the casing extension, while at this free end an operating handle for the mixing member is expediently provided.

In order to prevent the mixing member from being pushed back together with the piston during filling with the components of the preparation, it is advantageous to provide at the free end of the casing extension and on the operating stem, or on the operating handle, catch means which secure the operating stem to the casing extension when the mixing member is in the previously mentioned position in which it is pushed fully to the applicator end of the chamber containing the preparation.

In a preferred further development of the invention the compression spring is a coil spring which acts on the piston mounted in an overhung arrangement in the cylindrical casing in a manner known per se, while on the side of the piston facing the casing extension a tubular projection is provided, whose outside diameter is approximately equal to or only slightly smaller than the inside diameter of the turns of the coil spring, while the inside diameter of the casing extension is approximately equal to or only slightly larger than the outside diameter of the turns of the coil spring. By means of the tubular projection in the region of the piston end of the spring, and by means of the casing extension in the region remote from the piston, the coil spring, which is relatively long when the casing extension is extended, is therefore guided and secured against lateral displacements, which could for example lead to the hindering of the operation of inserting the casing extension for the purpose of raising the coil spring.

The chamber of variable size which contains the compression spring, and which lies opposite the chamber containing the preparation, is continuously vented to the atmosphere, for which purpose either a special vent hole can be provided in the end region of the casing or in the casing extension, or the fit of the casing extension in the casing, or of the operating stem in the through hole in the free end of the casing extension, allows sufficient clearance for the desired equalisation of pressure to be possible.

Figure 2:
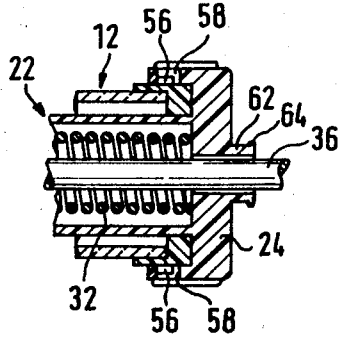

The invention is explained more fully in the following description of one example of embodiment, in conjunction with the drawing, in which:

FIG. 1 shows a longitudinal centre section through an application apparatus intended for preparing and applying a hair dye preparation and constructed in accordance with the invention, and FIG. 2 shows a sectional view, corresponding to the section in FIG. 1, through the rear end portion of the casing of the application apparatus according to the invention, while a casing extension mounted for telescopic sliding in the casing is shown in the position in which it is inserted into and locked to the casing.

The application apparatus 10 according to the invention, which is shown in FIGS. 1 and 2 of the drawing, comprises a handle part in the form of a cylindrical casing 12, whose front end wall 14 is in the form of a cover adapted to be unscrewed and is provided centrally with a self-closing filling and operating valve 16, which is in the form of a valve body 20 urged by a spring 18 onto a seal seat and lifted off its seat on the introduction of preparation, which is to be stored in the casing 12, by the filling nozzle of a preparation container, thus freeing the passage for the preparation into the interior of the casing.

Into the opposite end of the casing 12 is inserted a tubular casing extension 22, which is adapted to slide telescopically between the fully extended position shown in FIG. 1 and the fully retracted position shown in FIG. 2. The end of the casing extension 22 remote from the casing is in the form of an end cap 24, which in the fully inserted position engages over the rear end region of the casing 12.

The interior of the casing 12 is subdivided by a freely slidable, that is to say overhung piston 26 into two chambers which are sealed against one another, and of which the chamber 28 lying on the valve side serves to receive the preparation which is to be applied, while in the chamber 30 lying opposite a coil spring 32, supported on the rear side of the piston 26 and the interior of the end cap 24 of the casing extension 22, is inserted under compressive prestress. The coil spring 32 therefore urges the piston 26 in the direction of the front end wall 14. The valve 16 disposed in the end wall 14 nevertheless prevents the displacement of the piston 26 as long as it is closed. Between the front end wall 14 and the piston 26 there is additionally disposed in the chamber 24 a mixing member 34 in the form of a body which is provided with a plurality of mixing blades and which is fastened on the inner end of an operating stem 36 passing sealingly and slidably through the piston 26 and the end cap 24 of the casing extension 22. When the piston 26 has been moved to the right in FIG. 1 through the filling of the chamber 28 with preparation by way of the valve 26, thereby reducing the size of the chamber 30, the preparation contained in the chamber 28 can be mixed through the reciprocating movement of the operating stem 36 and thus of the mixing member 28 mounted on it. In order to facilitate the reciprocating movement of the operating stem, an operating handle 38 is disposed on its free end. The mixing operation described is necessary when the preparation which is to be applied consists of two or more components introduced separately into the chamber 28 receiving the preparation.

During the filling of the chamber 28 receiving the preparation, the casing extension 22 is in the extended position shown in FIG. 1, in which the coil spring 32 has its maximum length, and in which it is only slightly prestressed. As the piston moves during the filling, the prestressing of the coil spring is increased, but its relatively great length ensures that the antagonistic pressure is not excessive, that is to say that the chamber 28 receiving the preparation can also be filled with preparation components from the aerosol cans, which are under only a relatively low propellant gas pressure.

On the end wall 14 of the casing 12 is mounted an applicator 40, which consists of a body 44 of plastics material, through which passes a through channel 42 and which on its side facing the end wall 14 is in the form of a cap engaging with a snap fit over the rear edge of the end wall 14. The through channel 42 leads at its free end into a tubular projection 46 which has a reduced diameter and which is surrounded by bundles of bristles 48 fastened in the body 36 of plastics material. At the end facing the self-closing valve 16, the through channel 42 leads into a projecting push rod member 50, which in the appropriate fastening position bears against the outer end of a valve tappet connected to the valve body 20, without lifting the valve body 20 off its seal seat. When however the applicator is additionally pulled slightly in the direction of the casing 12, out of the position shown in FIG. 1, the push rod member 50 opens the valve body 20, while the spring 18, thereby additionally compressed, again attempts to force the applicator 40 back. The locking of the cap part of the plastics body 44 on the end wall 14 is made possible by the fact that at the rear free end of the cap edge two tonguelike handles 52 lying opposite one another are integrally moulded, and engage under the annular edge of the end wall 14, which is in the form of a cover, so that when twisted in the direction of the casing 12 they move the applicator 40 (by the distance b) in the opening direction of the operating valve 16. During the application of the cosmetic preparation to the hair of a person undergoing treatment, the handles 52 have therefore only to be operated briefly and lightly on each occasion, whereby the operating valve 16 is opened and the preparation contained in the chamber 28 is forced out, via the through channel 42, between the bundles of bristles 48, by which it is then applied to and distributed over the part of the body being treated, for example a strand of hair over which a hair dye preparation has to be spread. In order to divide up and lift individual strands of hair which are to be treated, a toothed member 54 is also attached to the casing 12.

At the beginning of the utilisation of the application apparatus which has been filled, the prestressing additionally built up by the displacement in the casing of the piston 26, in the coil spring 32, will be sufficient to allow the preparation to pass out into the applicator 40 on operation of the handles 52 and hence of the valve 16. When the force of the spring then becomes weaker with increasing emptying of the chamber 28 and, particularly in the case of preparations of the consistency of a thick paste or dough, is no longer sufficient to drive out the preparation, the casing extension 22 can be pushed into the casing 12 as far as the position shown in FIG. 2, and can be locked in that position, whereby the coil spring 32 is once again so heavily stressed that the preparation contained in the chamber can be completely forced out. For the purpose of locking the casing extension 22 in the inserted position, a bayonet fastening is provided which is formed by two oppositely disposed short pinlike projections extending radially from the end region of the casing 12, together with appertaining sockets 58 in the end cap 24.

On the side facing the chamber 30 the piston 26 carries a tubular projection 60 which extends centrally in relation to the casing extension 22 and whose outside diameter is slightly smaller than the inside diameter of the turns of the coil spring 32. This projection 60 stabilises the end region of the coil spring, at the piston end, against lateral displacement, while the opposite end portion of the spring is stabilised by the casing extension 22, whose inside diameter is for that purpose made only slightly larger than the outside diameter of the turns of the coil spring 32.

In order to hold the mixing member 34 in the position shown in dot-dash lines in FIG. 1, in which it has been pushed into the immediate proximity of the operating valve 16, during the introduction of the preparation into the chamber 28, without the said mixing member being displaced together with the piston 26 by the preparation, the outer end face of the end cap carries a tubular portion 62 having, extending around it, an annular protection 64 extending radially outwards, or else a number of individual projections distributed at regular angular intervals, at the free end. The handle 38 is correspondingly provided on its side facing the end cap 24 with a socket 66, which in the position shown in dot-dash lines, engages over the portion 62 and which has a radially inwardly directed annular projection 68 which can be elastically opened out to snap over the annular projection 64.

We claim:

1. An apparatus for applying cosmetic preparations, in liquid or paste-like form, comprising: a closed, substantially cylindrical casing; a piston slidable in said casing, said piston dividing said casing into a first chamber and a second chamber of variable size and sealing said chambers relative to one another; said first chamber being adapted to be filled with a cosmetic preparation and to communicate with a detachable applicator, at a first end of said casing, for applying the preparation in controllable amounts; a compression spring in said second chamber urging said piston towards said first end reducing the size of said first chamber; a mixing member disposed in said first chamber; an operating stem connected to said mixing member for reciprocating said mixing member in said first chamber, said operating stem extending sealingly through said piston and extending through said second chamber; a tubular casing extension extending from said second chamber at a second end of said casing remote from said first end, said casing extension being slidable telescopically into said second chamber to a first end position, and out of said second chamber to a second end position; said casing extension having a free end; said compression spring having an end portion supported by said casing extension remote from said piston; an end cap at said free end and engageable over said second end of said casing in the first end position of said casing extension; and locking means in said end cap and on said second end of said casing, for detachably locking said casing extension to said casing at said second end when said extension is in said first end position.

2. An apparatus according to claim 1, wherein said locking means are bayonet fastening means in said end cap and at said second end of said casing.

3. An apparatus according to claim 1, wherein said operating stem has a length sufficient such that, in said first position of said casing extension and with said mixing member at said first end of said first chamber, said operating stem extends through an opening in said free end of said casing extension and protrudes with a stem portion beyond said free end, and an operating handle for said mixing member on said protruding stem portion.

4. An apparatus according to claim 3, comprising snap fastening means for detachably securing said operating stem to said casing extension, at said free end of said casing extension and on one of said operating stem and operating handle.

5. An apparatus according to claim 1, wherein said compression spring is a coil spring which engages said piston, a tubular projection on a side of said piston which faces the casing extension, said tubular projection having an outside diameter approximately equal to or slightly smaller than the inside diameter of said coil spring, said casing extension having an inside diameter which is approximately equal to or slightly larger than the outside diameter of said coil spring.

6. An apparatus according to claim 1, wherein said second chamber in vented to atmosphere.

* * * * *